US005602713A

United States Patent [19]

Kurogi et al.

[11] Patent Number: 5,602,713

[45] Date of Patent: Feb. 11, 1997

[54] ELECTRONIC DELAY DETONATOR

[75] Inventors: Kazuhiro Kurogi, Nobeoka; Tatsumi Arakawa, Yokohama, both of Japan

[73] Assignee: Asahi Kasei Kogyo Kabushiki Kaisha, Osaka, Japan

[21] Appl. No.: 454,380

[22] PCT Filed: Mar. 27, 1995

[86] PCT No.: PCT/JP95/00558

§ 371 Date: Mar. 28, 1996

§ 102(e) Date: Mar. 28, 1996

[87] PCT Pub. No.: WO95/33178

PCT Pub. Date: Dec. 7, 1995

[30] Foreign Application Priority Data

May 31, 1994 [JP] Japan ..... 6-119281

[51] Int. Cl.[6] ..... F23Q 7/02

[52] U.S. Cl. ..... 361/249; 102/217

[58] Field of Search ..... 361/248, 249, 361/251, 247; 102/217, 218

[56] References Cited

U.S. PATENT DOCUMENTS

| | | | |
|---|---|---|---|
| 4,395,950 | 8/1983 | Oswald . | |
| 4,445,435 | 5/1984 | Oswald . | |
| 4,586,437 | 5/1986 | Miki et al. | 102/220 |
| 5,363,765 | 11/1994 | Aikou et al. . | |
| 5,367,957 | 11/1994 | Hennessey | 102/217 |

FOREIGN PATENT DOCUMENTS

| | | |
|---|---|---|
| 212111 | 3/1987 | European Pat. Off. . |
| 2277319 | 1/1976 | France . |
| 3904563 | 9/1989 | Germany . |
| 52-21754 | 2/1977 | Japan . |
| 61-25079 | 6/1986 | Japan . |
| 1-285800 | 11/1989 | Japan . |
| 3-155206 | 7/1991 | Japan . |
| 3-155205 | 7/1991 | Japan . |
| 4-207304 | 7/1992 | Japan . |

OTHER PUBLICATIONS

PCT International Search Report dated Jul. 6, 1995.

*Primary Examiner*—Jeffrey A. Gaffin
*Assistant Examiner*—Michael J. Sherry
*Attorney, Agent, or Firm*—Finnegan, Henderson, Farabow, Garrett & Dunner, L.L.P.

[57] ABSTRACT

An electronic delay detonator in which only energy is received only from a blasting unit to determine a delay time, has an oscillating circuit (20) which outputs oscillation pulses in a first transitory oscillation state in which the oscillation pulses are output immediately after the oscillating circuit (20) starts to operate based on storage energy stored in an energy storing circuit (9), and in a second steady oscillation state. The steady oscillation state of the oscillating circuit is switched, based on an enable signal generated after a predetermined period of time.

13 Claims, 16 Drawing Sheets

ELECTRONIC DELAY DETONATOR

TECHNICAL FIELD

The present invention relates to an electronic delay detonator for receiving energy only from a blasting unit, for driving a delay circuit based on the energy, and for igniting a detonator after a predetermined delay time.

BACKGROUND ART

In order to reduce vibration and noise in blasting, there has been proposed a blasting method which utilizes the interference of a blasting sound wave, in which method a precise explosion time control is required (the Japanese Patent Application Laid-Open (285800/1989).

A circuit for achieving the explosion time control having such precision, is an electronic delay detonator proposed in, for example, U.S. Pat. No. 4,445,435 granted to Atlas et al.

The electronic delay detonator includes an oscillating circuit using a crystal vibration element as a reference and a counter for counting output pulses from the oscillating circuit to digitally measure time, and is designed such that the counter is reset (initialized) based on a signal from a blasting unit.

FIG. 1 is a diagram showing a conventional electronic delay detonator, and FIG. 2 is a timing diagram of the operation of a conventional detonator.

The structure and operation of the conventional delay detonator will be described below with reference to FIG. 1 and 2.

In FIG. 1, a reference numeral 1 denotes a blasting unit. The blasting unit 1 is connected to input terminals 6-A and 6-B of an electronic delay detonator 16 via blasting unit busbars 2, auxiliary busbars 3, and lines 4. Reference numerals 5-1 to 5-6 are connection nodes therebetween.

A conventional electronic delay detonator 16 includes a signal detecting circuit 7, a rectifying circuit 8, an energy storing capacitor 9, an oscillating circuit 10, a counter 11, a discharge circuit 14, and an ignition heater 15.

To effect an explosion, the blasting unit 1 supplies to the electronic delay detonator 16 a signal as a reference for an explosion delay time; and also supplies the power, as energy, used to measure the explosion delay time, and to cause the explosion.

The power from the blasting unit 1 is supplied via the rectifying circuit 8 and stored in the energy storing capacitor 9, which constitutes an energy storing circuit.

An input voltage Vs shown in FIG. 2 is for the signal and the energy supply. The signal is transmitted as a change in the amplitude of the input voltage Vs; and it is detected by a detonator signal detecting circuit 7 of the electronic delay detonator 16.

When the input voltage Vs is applied to input terminals of the electronic delay detonator from the blasting unit 1, energy is stored in the energy storing capacitor 9, as shown as the voltage across terminals, of the energy storing capacitor in FIG. 2. After a period of time sufficient for the storage of energy in the energy storing capacitor 9, the application of input voltage is stopped at an arbitrary time. The change of the amplitude of the input voltage Vs is detected by the signal detecting circuit 7, which generates a reset signal R. The counter 11 is initialized in response to the reset signal R, and starts to count output pulses P from the oscillating circuit 10. After a delay time set in the counter 11, the counter 11 outputs a trigger signal. In response to the trigger signal, the discharge circuit 14 supplies the energy stored in the energy storing capacitor 9 to the ignition heater 15 for effecting the explosion.

The oscillating circuit 10 and counter 11 continue to operate even if the input voltage Vs is no longer applied, because the power is supplied from the energy storing capacitor 9.

In the conventional electronic delay detonator, when waveform distortion occurs in the waveform of input voltage Vs caused by any external factors, there is the possibility that Wave form distortion is detected by the signal detecting circuit. 7 and the reset signal is erroneously generated. In this case, the electronic delay detonator to which the input voltage Vs having the distortion is input would cause an explosion at a time earlier than that determined by any based on the set delay time.

As one of the external factors a situation could occur where the connection nodes 5-1 to 5-6 to which lines are connected manually, have contact resistance.

For this reason, there has been proposed an electronic delay detonator in which energy is received only from a blasting unit to start the operation of the oscillating circuit, and a counter digitally counts output pulses from the oscillating circuit after a predetermined period of time.

Such an electronic delay detonator can operate with no relationship to the distortion of an input signal because only the energy is received and a reset signal for the counter is generated internally.

An example of electronic delay detonator having such a structure is disclosed in the U.S. Pat. No. 5,363,765.

In the electronic delay detonator disclosed in the U.S. Pat. No. (5,363,765), in order to shorten a period of time until stable oscillation is achieved without changing the oscillation frequency, over-excitating is utilized in the oscillating circuit. In this structure, large current is required.

DISCLOSURE OF INVENTION

In an electronic delay detonator having the structure in which energy only is received from a blasting unit to determine a delay time, the delay time is measured from the time that electric energy starts to be supplied from the blasting unit to the electronic delay detonator. For this reason, in order to improve the precision of the delay time, it is necessary to shorten the period of time from the start of operation of the oscillating circuit to the time it enters a steady oscillation state.

Further, in the electronic delay detonator, because the energy only received from the blasting unit and stored in the energy storing circuit, is used for measuring the explosion delay time and for effecting the explosion, the power consumption for measuring the explosion delay time is necessarily suppressed as much as possible because of the structure and to avoid an accidental explosion caused by stray current at a blasting site. In addition, when a large number of detonators are connected to the blasting unit, it is necessary to confirm that connection of each of the detonators is performed correctly.

In conventional techniques, countermeasure for these problems are not always sufficient.

Therefore, a first object of the present invention is to shorten the period of time from the start of operation of an oscillating circuit used in an electronic delay detonator to the time it can oscillate stably, for increasing the precision of a delay time, in the electronic delay detonator in which energy only is received from a blasting unit to determine a delay time.

A second object of the present invention is to increase the precision of the delay time, in an electronic delay detonator in which energy is received only from a blasting unit to determine the delay time, without measuring the period of time from the start of operation of an oscillating circuit used in an electronic delay detonator to the time it can oscillate stably.

A third object of the present invention is to reduce power consumption of an oscillating circuit used in an electronic delay detonator, in which energy only is received from a blasting unit to determine, the delay time.

A fourth object of the present invention is to provide an electronic delay detonator having a structure for avoiding an accidental explosion caused by stray current at a blasting site.

A fifth object of the present invention is to provide an electronic delay detonator whose connections to other detonators can be confirmed.

An electronic delay detonator according to the present invention includes first and second input terminals receiving electric energy supplied from a blasting unit, a rectifying circuit having an input connected to at least one of the first and second input terminals, an energy storing circuit connected to an output of the rectifying circuit, an oscillating circuit for outputting oscillation pulses which operates based on storage energy in said energy storing circuit and which has a first transit oscillation state in which the oscillation pulses are output immediately after the oscillating circuit starts to operate based on storage energy stored in the energy storing circuit, and in a second steady oscillation state; an enable signal generating circuit for detecting an elapsed time relative to a time of starting the supply of electric energy by the blasting unit to generate an enable signal, an oscillation state switching circuit for switching from the first oscillation state to the second oscillation state in response to the enable signal, a trigger signal generating circuit for generating a trigger signal in response to a counted predetermined number of above oscillation pulses, and a discharge circuit for discharging the stored electrical energy in response to the trigger signal.

Oscillating circuits having various structures may be used as the above oscillating circuit for outputting oscillation pulses which operate based on stored energy, and which has the first transitory oscillation state in which the oscillation pulses are output immediately after the oscillating circuit starts to operate, and a second steady oscillation state.

The oscillating circuit is a solid state oscillating circuit comprising an inversion type of amplifier including a feed-back circuit having a solid state vibration element and a load capacitor whose capacitance is changed by the oscillation state switching circuit.

The oscillating circuit comprises a solid state oscillating circuit portion, and a CR oscillating circuit portion connected to the solid state oscillating circuit portion in a cascade manner, an operation of the CR oscillating circuit is stopped in response to the oscillation state switching circuit.

The oscillating circuit is a solid state oscillating circuit comprising an inversion type of amplifier including a feed-back circuit having a solid state vibration element and a capacitor; and a power supply voltage supplied to the solid state oscillating circuit is switched to a lower voltage in response to the oscillation state switching circuit.

Further, the electronic delay detonator according to the present invention may have a structure in which a counting circuit included in the trigger signal generating circuit does not count the oscillation pulses from the oscillating circuit during the first transitory oscillation state.

In the structure of the electronic delay detonator, the oscillating circuit is a solid state oscillating circuit comprising an inversion type of amplifier including a feed-back circuit having a solid state vibration element and a load capacitor whose capacitance is changed by the oscillation state switching circuit, and the trigger signal generating circuit comprises a counting circuit for counting the oscillation pulses, and a reset circuit for holding the counting circuit in a reset state from the start of the supply of electric energy, and releasing the counting circuit from the reset state in response to the enable signal.

Further, in the electronic delay detonator, the oscillating circuit is a solid state oscillating circuit comprising an inversion type of amplifier including a feed-back circuit having a solid state vibration element and a capacitor, and a circuit for switching a power supply voltage to be supplied to the solid state oscillating circuit to a lower voltage in response to the oscillation state switching circuit, and the trigger signal generating circuit comprises a counting circuit for counting the oscillation pulses, and a reset circuit for holding the counting circuit in a reset state from the time the electrical energy starts to be supplied, and releasing the counting circuit from the reset state in response to the enable signal.

The oscillating circuit uses a solid state oscillating circuit, the inversion type of amplifier used in the solid state oscillating circuit includes C-MOS transistors, and includes a current limiting circuit for limiting current supplied to the C-MOS transistors.

The electronic delay detonator comprises a by-pass circuit provided between the first and second input terminals and includes a linear or a non-linear resistor element.

According to the present invention, since the oscillating circuit in the electric delay detonator for outputting oscillation pulses has the first transitory oscillation state in which the oscillation pulses are output immediately after the oscillating circuit starts to operate based on energy stored in the energy storing circuit, and in the second steady oscillation state in which the oscillation pulse are stable, a period of time from the start of operation of the oscillating circuit to establishment of the steady oscillation state can be shortened.

Further, if there is used an oscillating circuit in which the power consumption in the first oscillation state is equal to or less than that in the second steady oscillation state, the power consumption does not increase much; and also the oscillation pulses can be output immediately.

For this reason, the delay time of the electronic delay detonator can be set correctly.

The oscillating circuit having the first transitory oscillation state and the second steady oscillation state according to the present invention can be achieved from various circuits.

By making the variable load capacitor have a small capacitance at the initial stage of oscillation and switching capacitance of the load capacitor to a value matching the characteristic of the solid state vibration element after steady oscillation is established, it is possible to suppress the current consumption at the initiation of oscillation, and to establish the steady oscillation state in an extremely short time. Therefore, an oscillating circuit can be achieved which operates stably after the steady oscillation state is established.

In a case where the oscillating circuit comprises the solid state oscillating circuit, and the CR oscillating circuit are connected in a cascade manner such that the frequency of the CR oscillating circuit is forcedly synchronized with that of the solid state oscillating circuit, the digital time measuring is made possible by counting the output pulses from the CR oscillating circuit until the solid state oscillating circuit establishes the steady oscillation state.

The output pulses can be output immediately by switching the power supply voltage supplied to the solid state oscillating circuit of the oscillating circuit by the oscillation state switching circuit such that a voltage of the energy storing circuit is applied at the initial stage and then a reduced voltage is applied at the subsequent state.

The high precise time measurement can be achieved by not counting the output pulses output during the first transitory oscillation state of the oscillating circuit or even by counting oscillation pulses during the state depending on the length of the state and the preciseness of oscillation.

The power consumption of the oscillating circuit can be reduced since the solid state oscillating circuit using the inversion type of amplifier comprising C-MOS transistors is used as the oscillating circuit so that the current supplied to the C-MOS transistors is restricted.

The electronic delay detonator can be used safely from objectionable stray current occurring at a blasting site by providing the by-pass circuit; and further, by using this by-pass circuit the conductive state of multiple connections among detonation can be tested.

The safety can be ensured by using a non-linear resistor element in the by-passing circuit as well as using a liner resistor element and the number of targets to be blasted can be increased in a normal blasting because the energy loss in the by-pass circuit is suppressed to a minimum.

BEST MODE FOR CARRYING OUT THE INVENTION

The embodiments of the present invention will be described below with reference to the accompanying drawings.

First Embodiment

Figure 1:
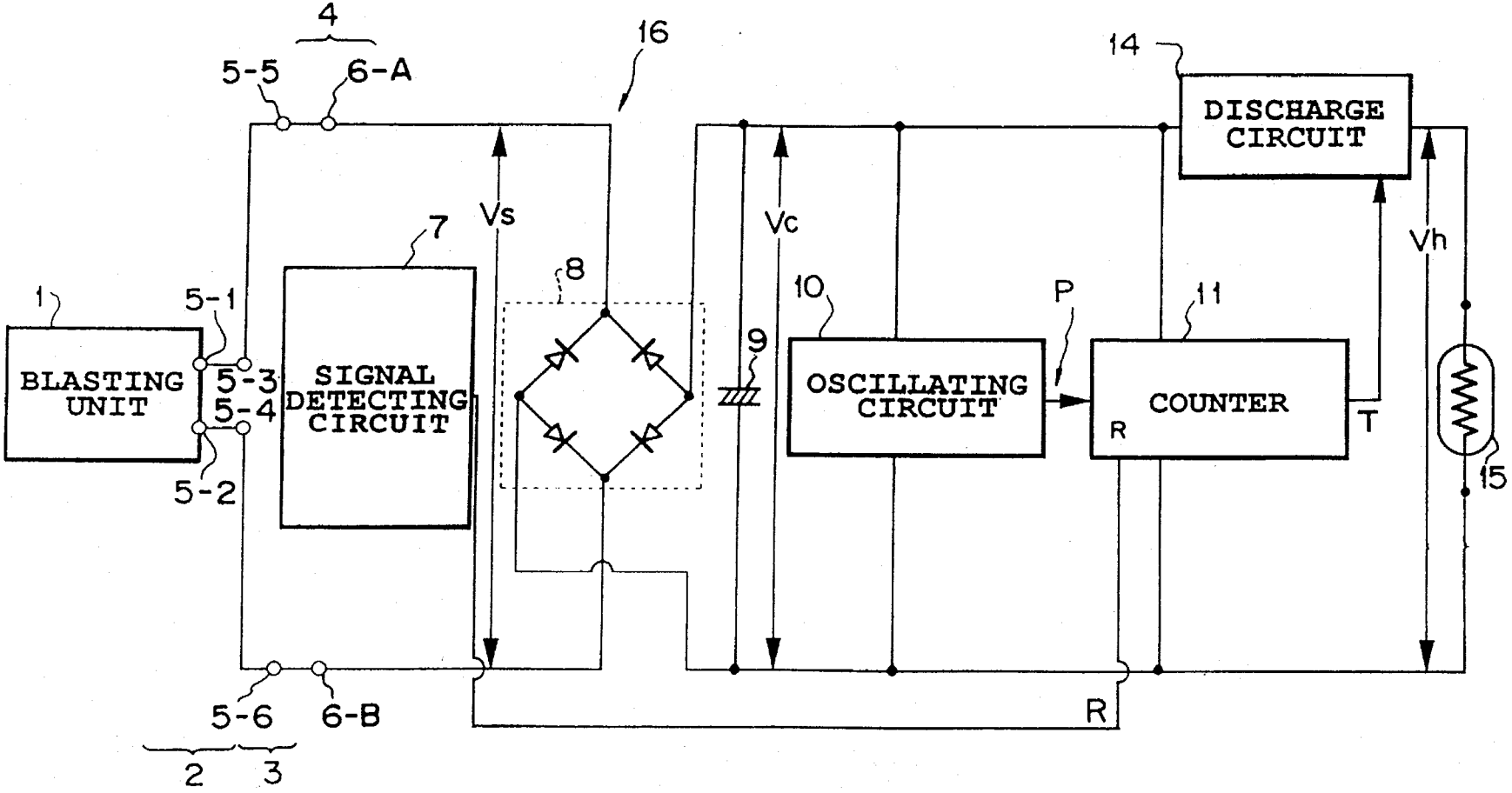
FIG. 1 PRIOR ART
FIG. 1 is a block diagram of an example of a conventional electronic delay detonator.
Figure 2:
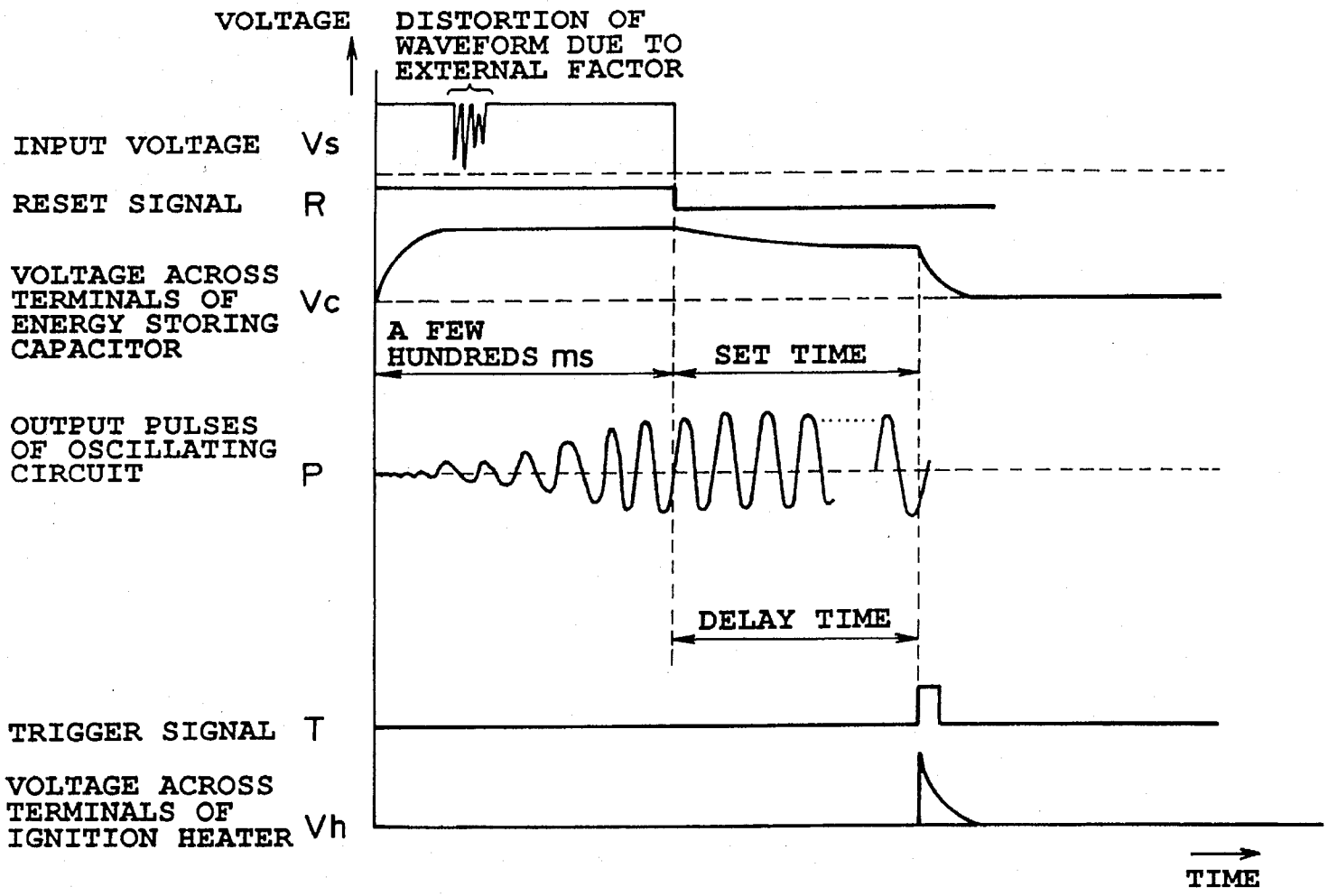
FIG. 2 PRIOR ART
FIG. 2 is a timing chart of the operation of the conventional example.
Figure 3:
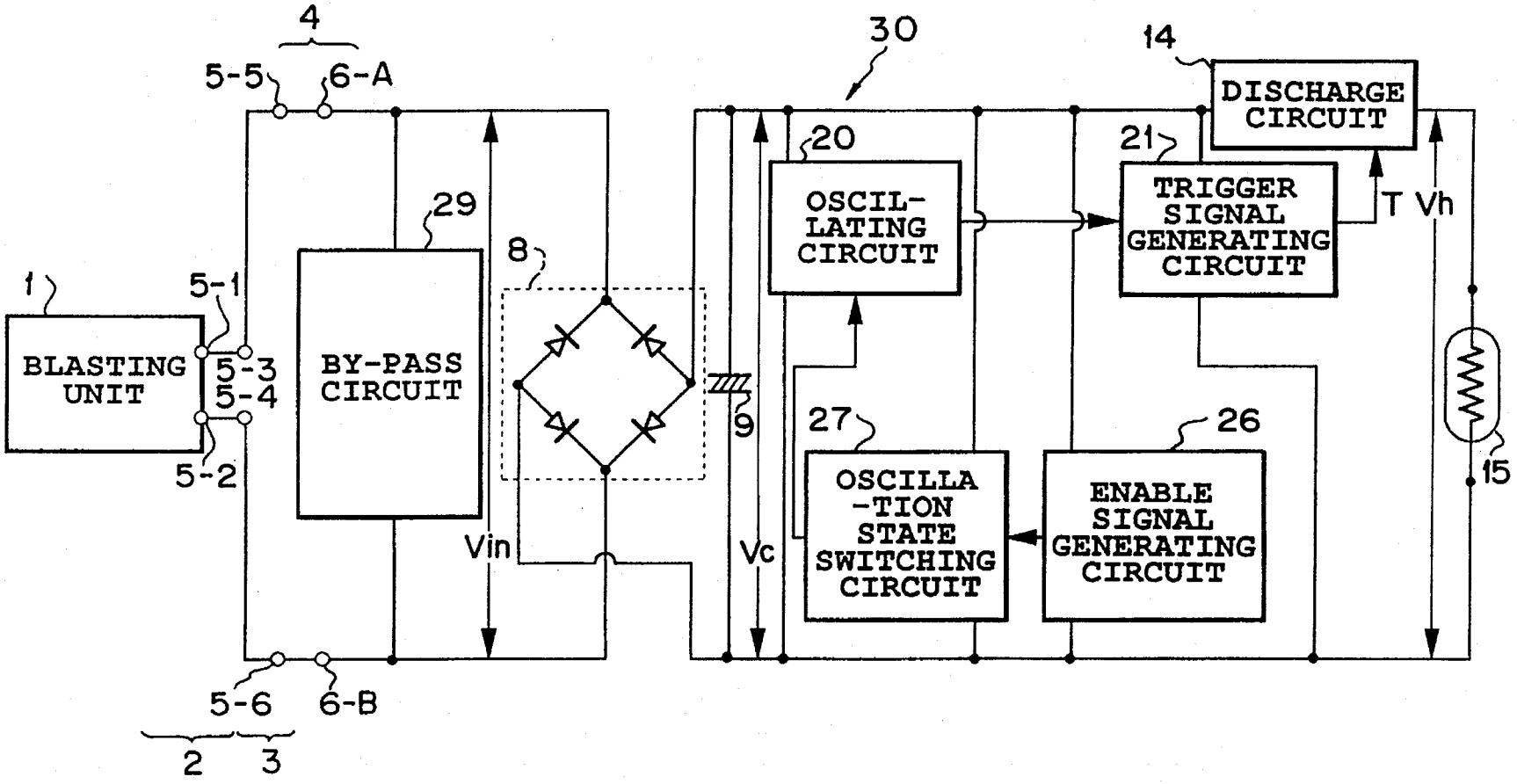
FIG. 3 is a block diagram showing a first embodiment of the present invention.
Figure 4:
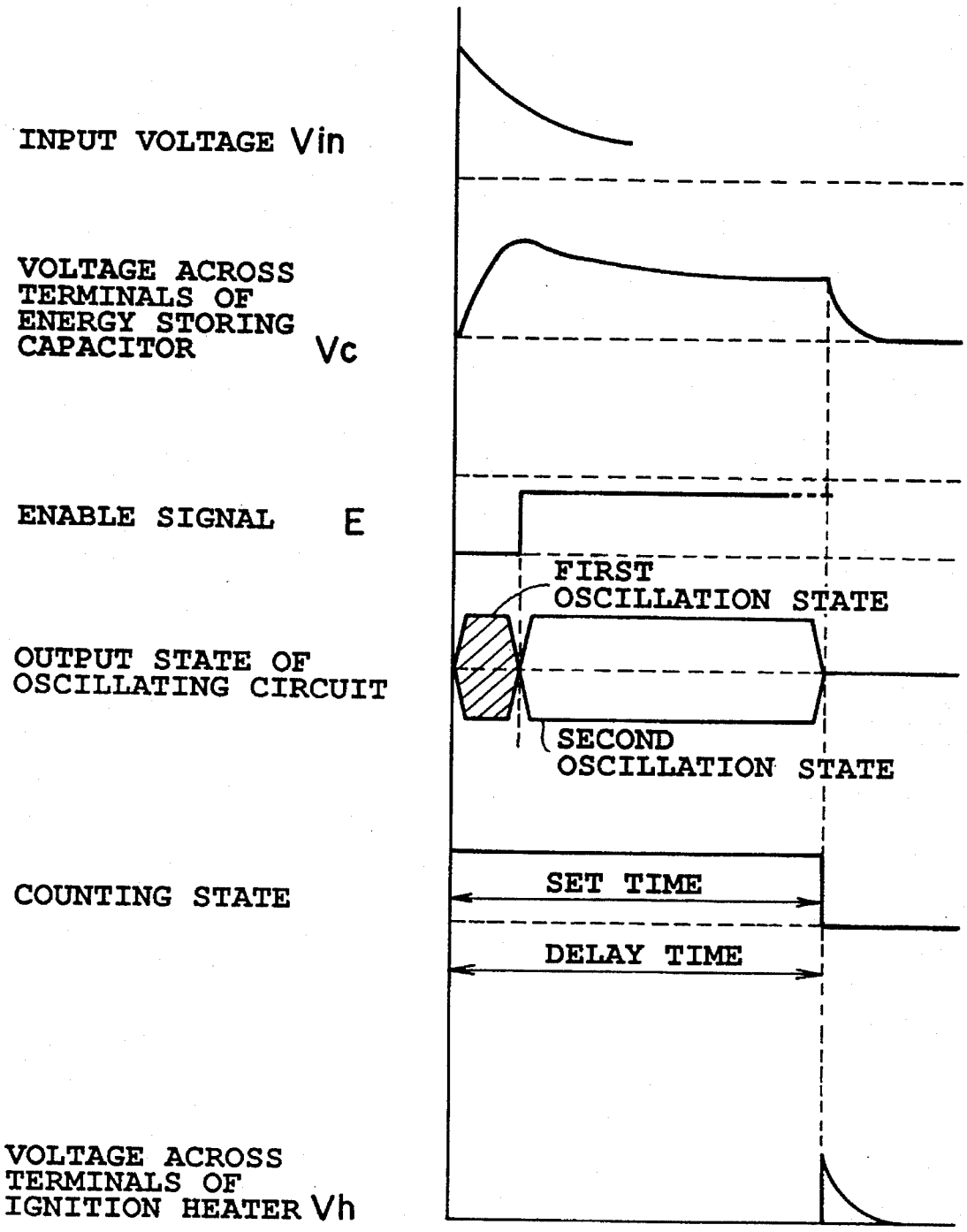
FIG. 4 is a timing chart of the operation of the first embodiment.

FIG. 3 is a block diagram showing an electronic delay detonator according to an embodiment of the present invention. FIG. 4 is an operation timing flow chart showing the operation timing flow of the delay detonator. In FIG. 3 the same components as in FIG. 1 are assigned the same reference numerals, and the description will be omitted.

In FIG. 3, a reference numeral 20 denotes an oscillating circuit, a reference numeral 21 denotes a trigger signal generating circuit, a reference numeral 26 denotes an enable signal generating circuit, and a reference numeral 27 denotes an oscillating state switching circuit. A reference numeral 29 is a by-pass circuit. These circuits constitute a part of the electronic delay detonator.

The operation of the embodiment of the present invention shown in FIG. 3 will be described below with reference to the operation timing chart of FIG. 4.

An input voltage Vin is applied from a blasting unit 1 to input terminals 6-A and 6-B of the electronic delay detonator in blasting. This voltage is stored as storage energy via a rectifying circuit 8 in an energy storing capacitor 9 which constitutes an energy storing circuit. It is a voltage Vc across terminals of the energy storing capacitor shown in FIG. 4 that shows the energy stored in the energy storing capacitor 9. The measurement of delay time and the initiation are performed based on the energy stored in the energy storing capacitor 9.

When energy is stored in the energy storing capacitor 9, the oscillating circuit 20 starts to oscillate immediately in a first transit oscillation state in response to the energy to output oscillation pulses. These oscillation pulses are input to the trigger signal generating circuit 21 and used to measure the delay time.

After a predetermined period of time, an enable signal E is output from the enable signal generating circuit 26 and it is input to the oscillating state switching circuit 27 to switch the oscillating state of the oscillating circuit 20 from the first transit oscillation state to a second steady oscillating state. The oscillating circuit 20 outputs the oscillation pulses in the second steady oscillating state. These pulses are also input to the trigger signal generating circuit 21 and used to measure the delay time. When the time is measured using the oscillation pulses and a period of time set in the trigger signal generating circuit 21 has elapsed, a trigger signal T is output from the trigger signal generating circuit 21 and input to a discharge circuit 14. When the trigger signal T is input, the discharge circuit 14 supplies the energy stored in the energy storing capacitor 9 to an ignition heater 15 and, as a result, an explosion occurred.

It is not always necessary that the frequency of the oscillation pulses output from the oscillating circuit 20 in the first transit oscillation state is the same as that of the oscillation pulses output from the oscillating circuit 20 in the second steady oscillation state. If the oscillation is started immediately in the first transit oscillation state, the frequency in the first state may deviate somewhat from that in the second steady oscillation state.

The by-pass circuit 29 is provided to by-pass stray current. The rectifying circuit 8 acts to prevent the energy stored in the energy storing capacitor 9 from flowing back to the by-pass circuit 29.

Safety standards on Stray current are determined in various jurisdictions and it must be suppressed in a predetermined range of permissible current to prevent explosion.

According to, for example, JIS K 4807 "electric detonator" in Japan, it is regulated that ignition should not be performed even when DC current of 0.25 A is applied for 30 sec. Also, according to an explosive power regulation law, Article 54 (1) of the rules in Japan, it is regulated that if there is leakage current at a blasting site, electric blasting should not be carried out but is not applicable to a situation where blasting is carried out by a safety method.

Further, in U.S.A., according to Federal Specification; X-C-51a 4.3.2.6 Test No. 3—firing current test., it is regulated that ignition should not be performed when DC current of 0.20 A flows for 5 seconds.

By flowing small amounts of current through the by-pass circuit 29, a conductive state test of the electronic delay detonator may be performed.

The by-pass circuit 29 may be constituted using a linear resistive element or non-linear resistive element.

In the embodiment shown in FIG. 3, the full wave rectifying circuit is described as an example of rectifying circuit. However, it may be a half wave rectifying circuit. In this case, the half wave rectifying circuit may be connected to either one of the input terminal 6-A or 6-B.

Second Embodiment

Figure 5:
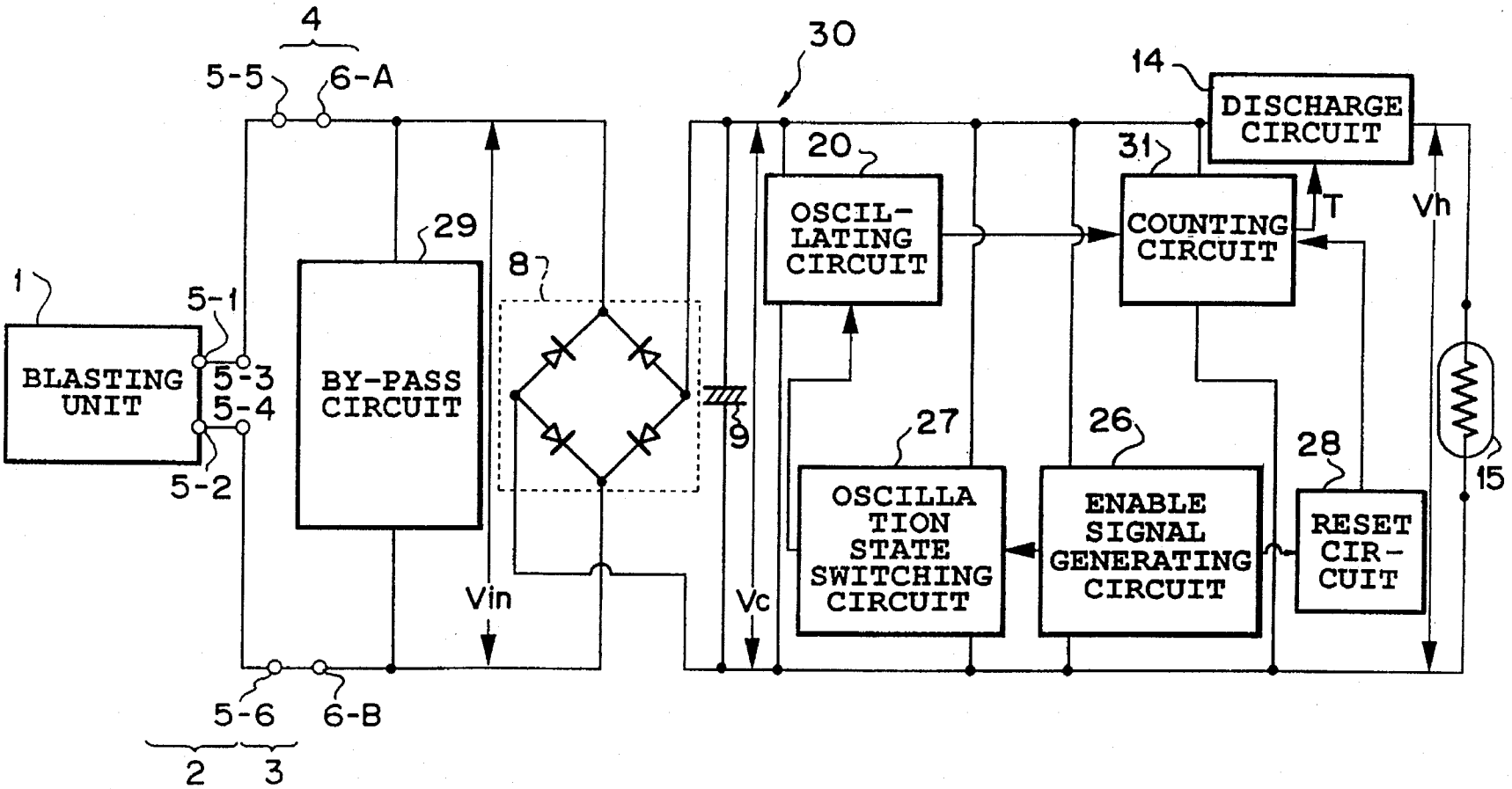
FIG. 5 is a block diagram of a second embodiment of the present invention.
Figure 6:
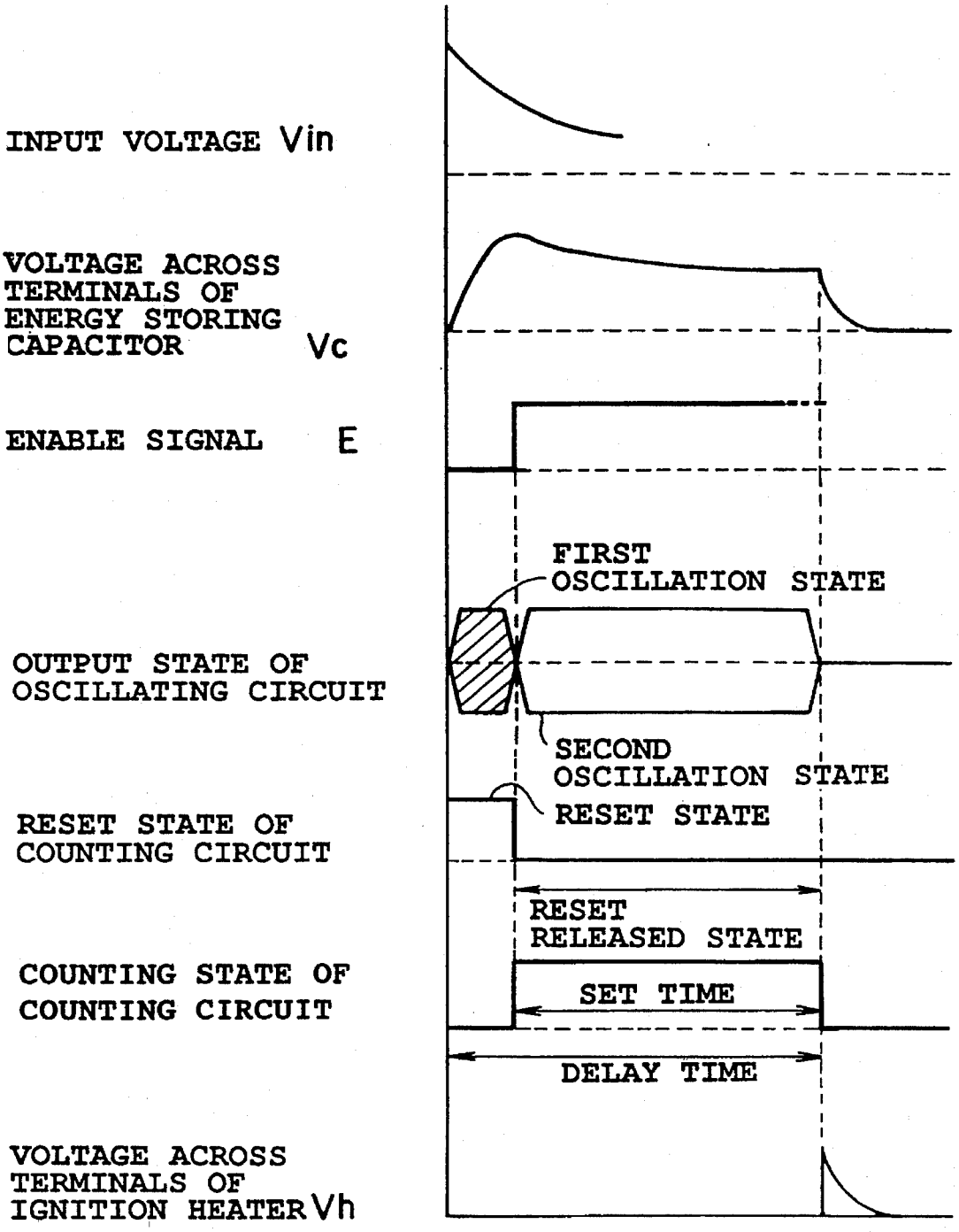
FIG. 6 is a timing chart of the operation of the second embodiment.

FIG. 5 is a block diagram showing the electronic delay detonator according to another embodiment of the present invention. FIG. 6 is an operation timing flow chart showing the operation timing flow. Here, in FIG. 5, the same components are assigned the same reference numerals as in FIG. 3 and the descriptions thereof will be omitted.

In FIG. 5, a reference numeral 31 denotes a counting circuit and a reference numeral 28 denotes a reset circuit. These circuits constitute a trigger signal generating circuit.

The oscillating circuit 20 starts to operate in the first transit oscillation state in response to the stored energy to output the oscillation pulses. These oscillation pulses are input to the counting circuit 31. However, because the counting circuit 31 is reset by the reset circuit 28, it does not count the oscillation pulses.

After a predetermined period of time has elapsed, the oscillating circuit 20 changes its state to the second steady oscillation state in response to the enable signal E from the enable signal generating circuit 26, and at that time the enable signal E is also supplied to the reset circuit 28. As a result, the counting circuit 31 is released from the reset state based on the output of the reset circuit 28 to start to count.

The counting circuit 31 counts the oscillation pulses for a time set in the counting circuit 31 and then generates the trigger signal T which is input to the discharge circuit 14. When the trigger signal T is input, the discharge circuit 14 supplies the energy stored in the energy storing capacitor 9 to the ignition heater 15 and as a result, the explosion is carried out.

In the embodiment shown in FIG. 3, the period of time during which the oscillating circuit 20 operates in the first transit oscillation state is included in the setting time. In this embodiment shown in FIG. 5, however, the period of time is not included in the setting time.

The oscillating circuit 20 oscillates immediately in the first transit oscillation state. In this case, however, the frequency of the transit oscillation is not always the same as that of the steady oscillation in the second state.

Further, there is a case where the oscillation pulses do not have an amplitude sufficient to count them during a period of time immediately after the oscillation is started, although the oscillation circuit 20 oscillates immediately in the first transit oscillation state.

Therefore, the setting time can be counted more precisely in the structure shown in FIG. 5 where the oscillation pulses obtained in the first transit oscillation state are not used to count the setting time.

Third Embodiment

Figure 7:
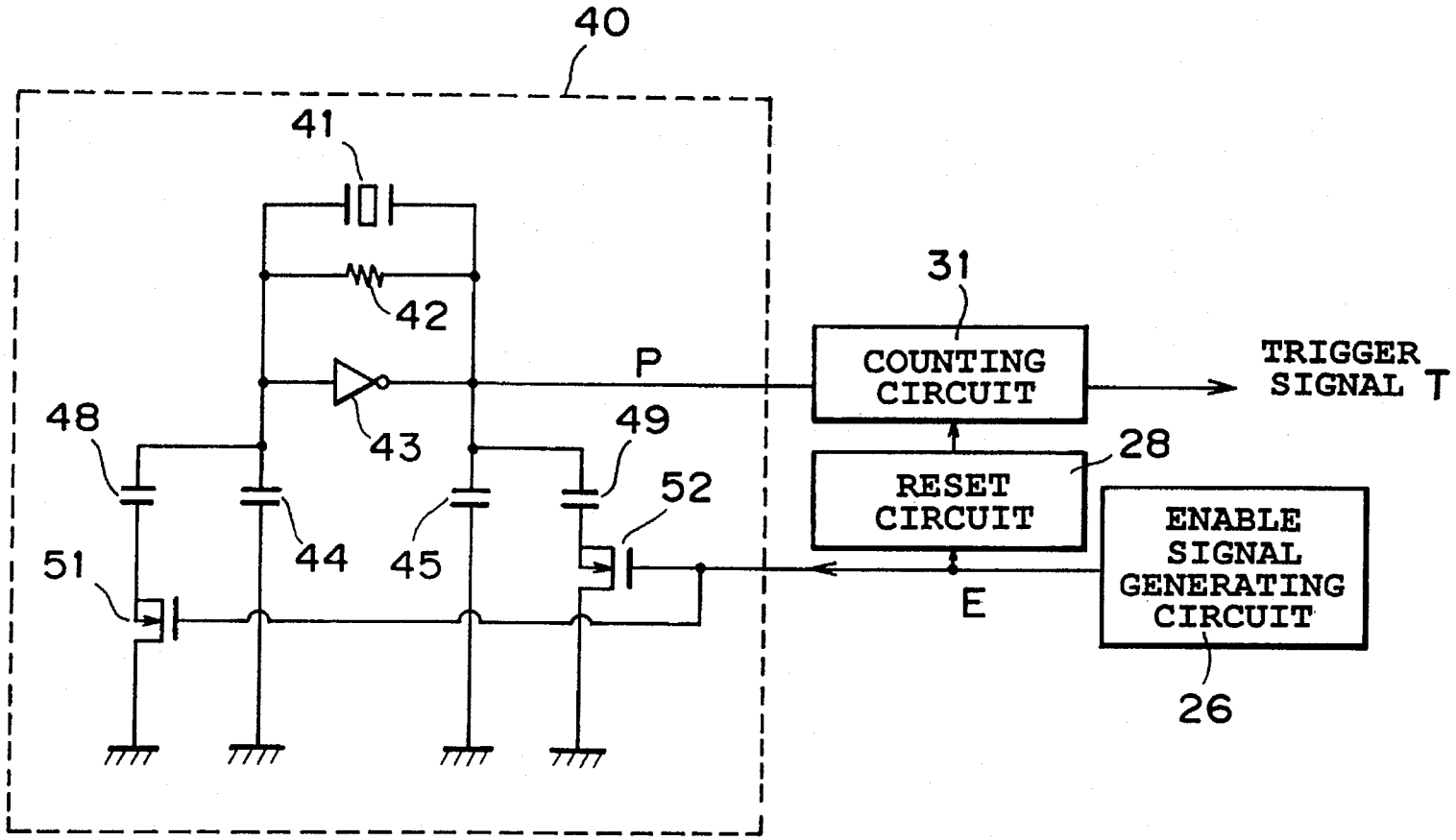
FIG. 7 is a block diagram of a third embodiment of the present invention.

FIG. 7 is an embodiment where the oscillating circuit 20 shown in FIG. 5, and used for the electronic delay detonator, constitutes a solid state oscillator having a variable load capacitance.

In FIG. 7, the same components as in FIG. 5 are assigned the same reference numerals, and the description will be omitted.

Reference numeral 41 is a solid state vibration element such as a crystal vibration element or a ceramic vibration element, reference numeral 42 a feed-back resistor, reference numeral 43 an inversion type of amplifier, reference numerals 44 and 48 gate capacitances, and reference numerals 45 and 49 drain capacitances. These elements constitutes a solid state oscillating circuit 40.

N-channel MOS transistors 51 and 52 which are switched by the enable signal generating circuit 26 constitute the oscillation state switching circuit 27 between the first oscillation state and the second oscillation state shown in FIG. 5.

The output of the enable signal generating circuit 26 is in a low or "L" state immediately after the power is turned on. At that time, the N-channel transistors 51 and 52 are turned off and the oscillation is initiated with only the gate capacitance 44 and only the drain capacitance 45. This state is the first oscillation state of the oscillating circuit 20.

After a predetermined period of time, the output of the enable signal generating circuit 26 changes to a high or "H" level. At that time, the N-channel MOS transistors 51 and 52 are turned on and the oscillation is performed with a synthetic capacitance of the gate capacitances 44 and 48 and a synthetic capacitance of the drain capacitances 45 and 49.

The capacitances 44 and 45 are minimum capacitances necessary to initiate the oscillation and the synthetic capacitance of the capacitances 44 and 48 and the synthetic capacitance of the capacitances 45 and 49, which are greater than the capacitances 44 and 45, respectively, are minimum capacitances necessary for the steady oscillation with a high precision.

For this reason, the solid state oscillating circuit 40 shown in FIG. 7 rises rapidly in the first transit oscillation state, although the oscillation frequency is somewhat different than oscillation in the second steady state of oscillation. Further, in the solid state oscillating circuit 40 shown in FIG. 7, the power consumption in the first transit oscillation state is less than that in the second steady state of oscillation.

In the present embodiment, the capacitances of 2 pF, 2 pF, 10 pF and 10 pF were selected as the capacitance 44, 45, 48 and 49, the initiation time in the first oscillation state can be shortened to about ⅕ of that where only the capacitances 48 and 49 are connected. As a result, the output in the first oscillation state is obtained immediately.

Here, because the optimal values of the capacitances 44, 45, 48 and 49 are greatly dependent upon the characteristics of solid state vibration element 41, the values are not limited to the values described in the embodiment.

Further, for the structure in which the load capacitance can be changed, a plurality of capacitors may be provided at the gate and/or drain of the inversion type of amplifier 43 to divide the load capacitors into the small capacitors for which switches are provided, and then the switches may be sequentially turned on by an oscillation initiating control circuit (not shown). In this case, it is possible to prevent a temporary unstable state of oscillation due to rapid change of the capacitances.

Furthermore, one or more capacitors may be provided in parallel with the capacitor of either the gate or drain of the inversion type of amplifier 43 such that the connection is controlled.

Figure 8:
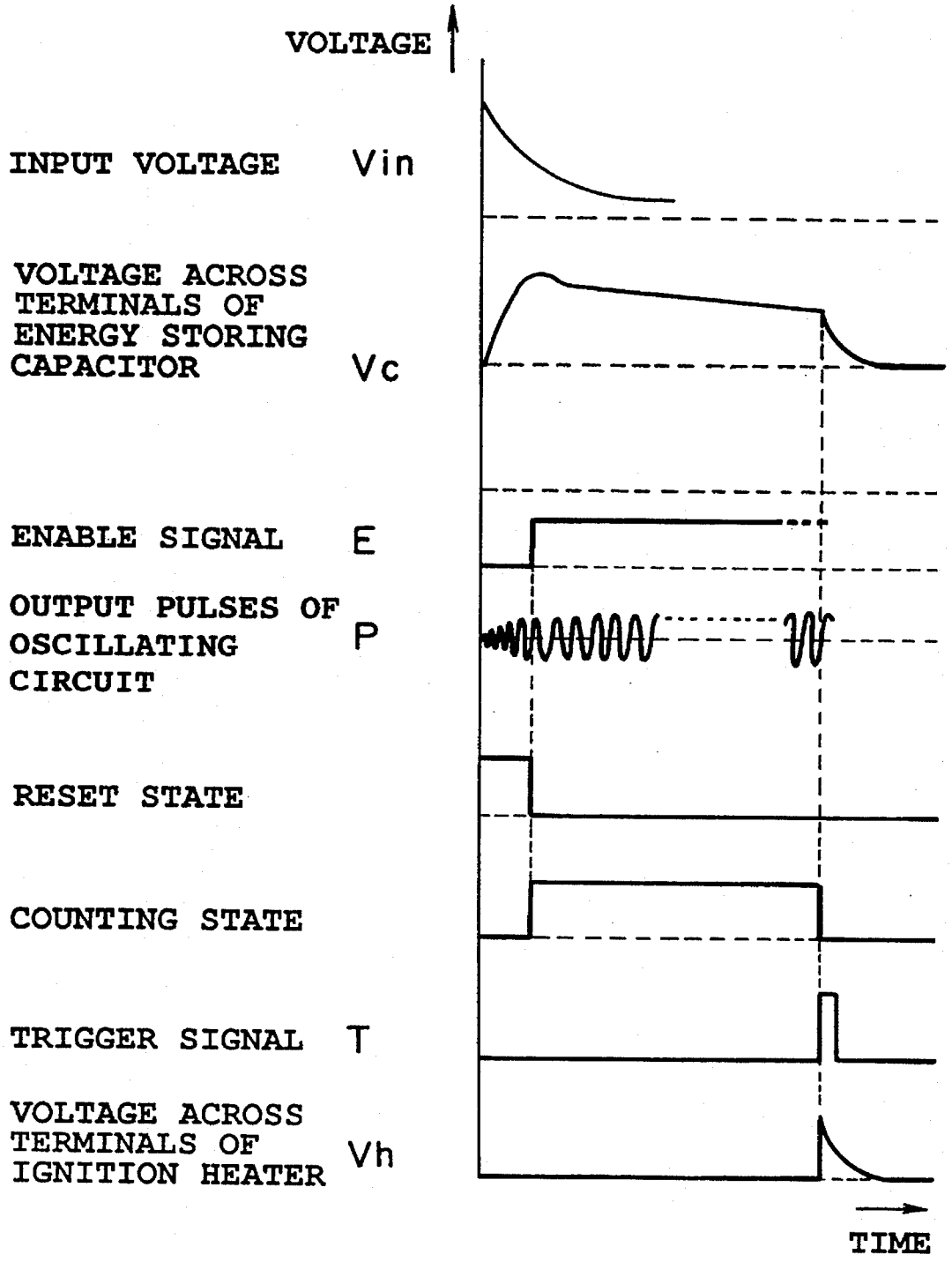
FIG. 8 is a timing chart of the operation of the third embodiment.

FIG. 8 is an operation timing diagram for the present embodiment.

The solid state oscillating circuit 40 shown in FIG. 7 is described as the embodiment of the oscillating circuit 20 which is used for the electronic delay detonator shown in FIG. 5. However, it could be understood readily to a person skilled in the art that the circuit 40 may be used as the oscillating circuit 20 in the first embodiment of the electronic delay detonator shown in FIG. 3.

The oscillating circuit is disclosed in, for example, Japanese Patent Application Laid-Open 155205/1991 and 155206/1991.

Figure 9:
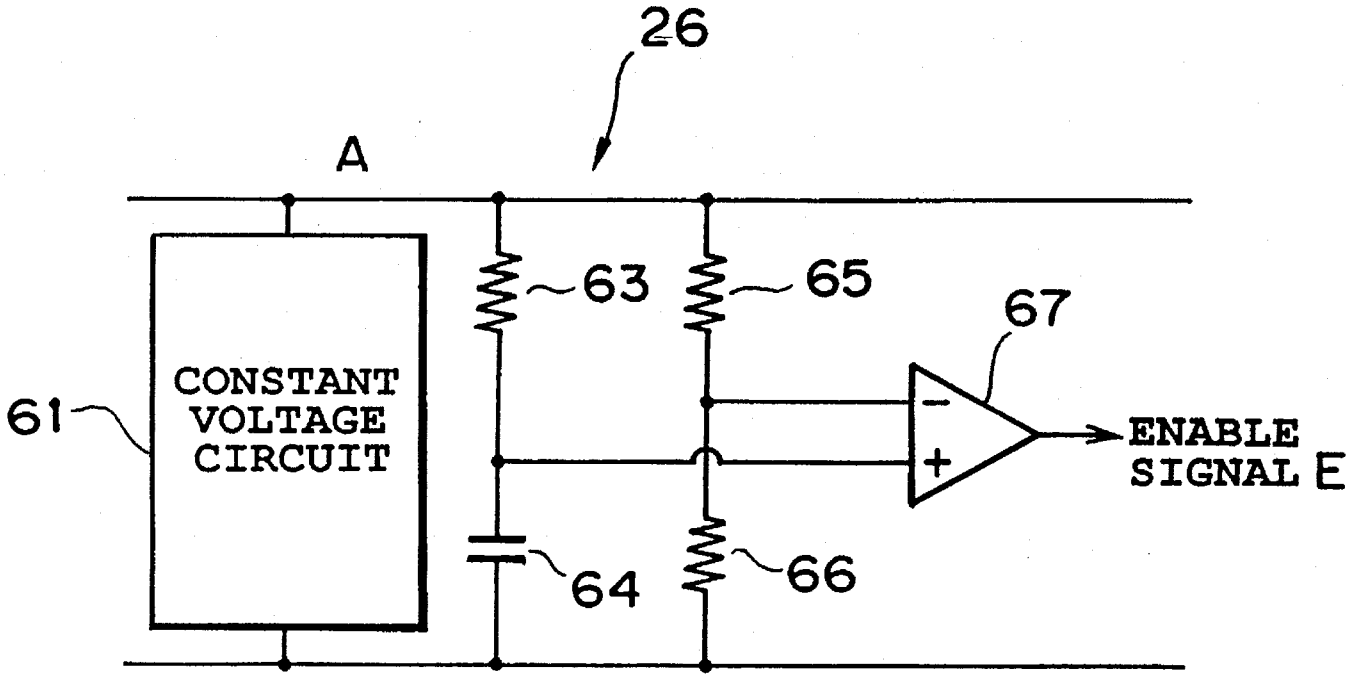
FIG. 9 is a circuit block diagram of an enable signal generating circuit according to an embodiment of the present invention.

An example of the enable signal generating circuit 26 used in the present embodiment is shown in FIG. 9.

The enable signal generating circuit 26 includes a constant voltage circuit 61, a resistor 63 and capacitor 64 used to determine a time constant, resistors 65 and 66 for determining a voltage level, and a comparator 67.

When a voltage is applied, the voltage of the capacitor across the terminals rises in accordance with the time constant based on the resistance of the resistor 63 and the capacitance of the capacitor 64 and after a predetermined period of time in which the voltage reaches the voltage level based on the resistors 65 and 66, the enable signal E is output from the comparator 67.

The enable signal E is applied to transistors 51 and 52 which constitute the oscillation state switching circuit 27.

Additionally, when the enable signal E is supplied to the reset circuit 28, which holds the counting circuit 31 in a reset state, the reset state of the counting circuit is released.

Fourth Embodiment

Figure 10:
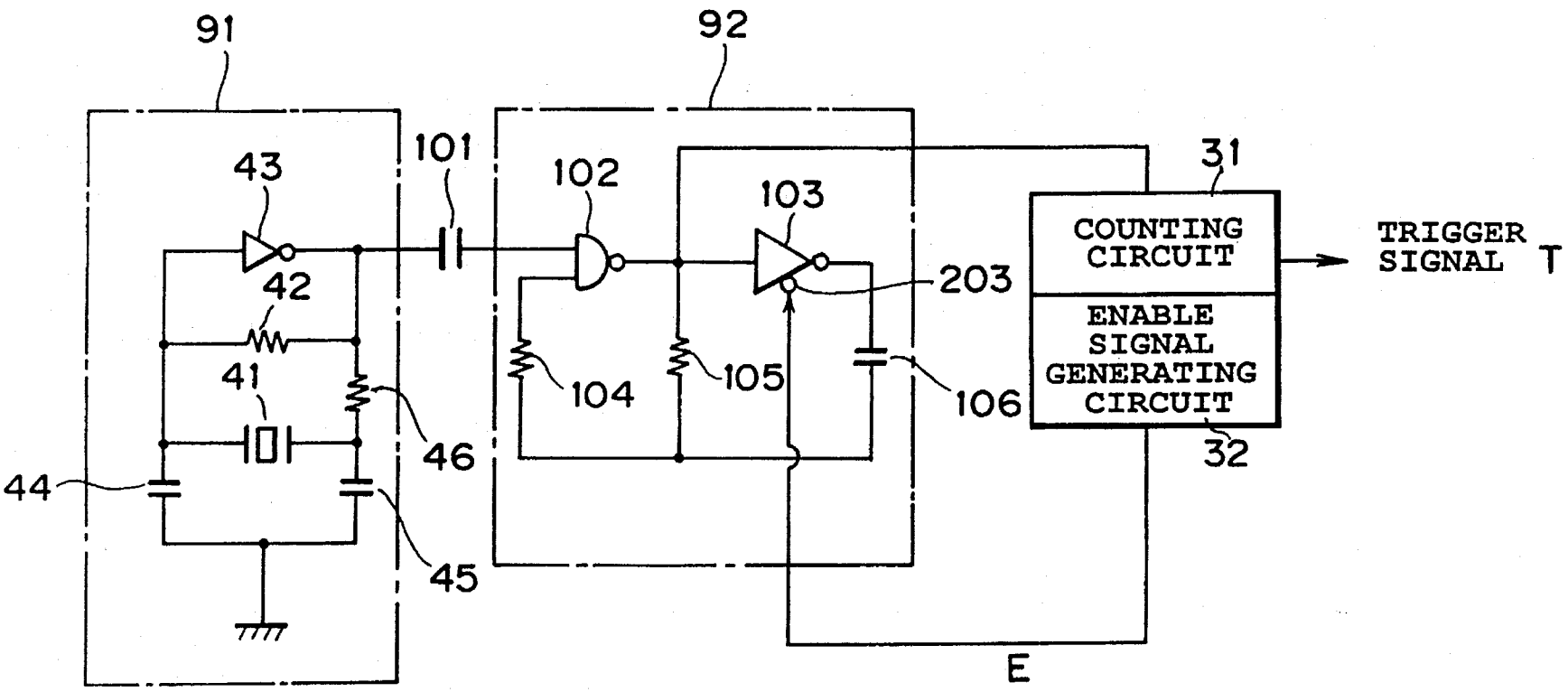
FIG. 10 is a block diagram of a fourth embodiment of the present invention.

FIG. 10 is a diagram showing an embodiment of the oscillating circuit 20 composed of a solid state oscillating circuit and a CR oscillating circuit and used for the electronic delay detonator shown in FIG. 3.

Figure 11:
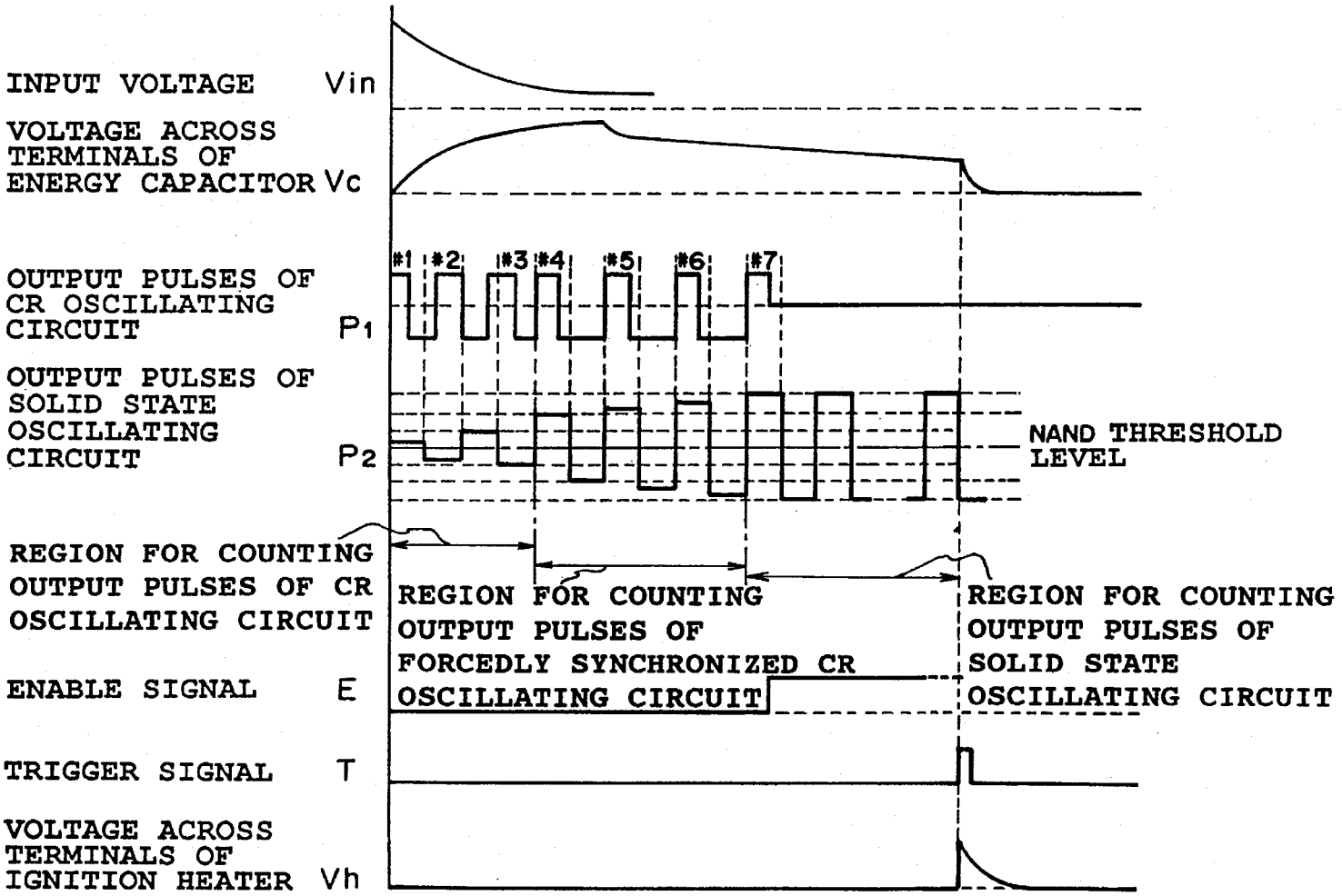
FIG. 11 is a timing chart of the operation of the fourth embodiment.

FIG. 11 shows the operational timing in the present embodiment (the waveform is shown as a rectangular wave for readily understanding).

In FIG. 10, the same components as in FIGS. 3 and 7 are assigned the same reference numerals.

In FIG. 10, a solid state oscillating circuit 91 includes a solid state vibration element 41, a feed-back resistor 42, an inversion type of amplifier 43, a gate capacitor 44, a drain capacitor 45, and series resistors 46 of the solid state vibration element 41.

Also, a CR oscillating circuit 92 includes a capacitor 101 for synchronization, NAND gate 102, an inversion type of amplifier 103 with a control terminal, resistors 104 and 105, and a capacitor 106. The oscillating circuit 20 comprises the solid state oscillating circuit 91 and the CR oscillating circuit 92.

A reference numeral 31 denotes a counting circuit for counting oscillation pulses to a predetermined value to output a trigger signal T.

With reference to the operation timing shown in FIG. 11, the embodiment of the oscillating circuit 20 shown in FIG. 10 will be described below.

The CR oscillating circuit 92 is not comparable to the solid state oscillating circuit 91 in the oscillation precision but starts a steady or stable oscillation in an extremely short period of time.

In the initial state immediately after the power is turned on, the amplitude of an output pulse P2 from the solid state oscillating circuit does not reach a threshold level of the NAND gate 102, and therefore, the CR oscillating circuit 92 does not sense the output from the solid state oscillating circuit 91 and oscillates itself with a time constant determined by the resistor 105 and the capacitor 106 to output an output pulse P1.

After the amplitude of the output pulse P2 from the solid state oscillating, circuit 91 exceeds the threshold level of the NAND gate 102, the output from the CR oscillating circuit 92 is forcedly synchronized with the output from the solid state oscillating circuit 91. At this time, the frequency of the output pulses P1 from the CR oscillating circuit 92, which are forcedly synchronized with the solid state oscillating circuit 91 is the same as that of the output pulses P2 from the solid state oscillating circuit 91.

The counting circuit 31 outputs the trigger signal T and outputs a signal when a predetermined period of time shorter than a setting time is measured, as well. This second signal is input to the enable signal generating circuit 32 to be used to generate the enable signal E. When the enable signal generating circuit 32 receives the signal from the counting circuit 31, the enable signal E is supplied to a control terminal 203 of an inverter 103 which constitutes the oscillation state switching circuit, to stop the operation of the inverter 103, and thereby stop the oscillation of the CR oscillating circuit 92.

Thereafter, the output pulses P2 from the solid state oscillating circuit 91 are input to the counting circuit 31.

In the present embodiment, the oscillating circuit 20 constitute the solid state oscillating circuit 91 and the CR oscillating circuit 92. The state in which the CR oscillating circuit 92 outputs pulses is the first oscillation state of the oscillating circuit 20 and the state in which the CR oscillating circuit 92 is stopped and the solid state oscillating circuit 91 outputs pulses is the second state of oscillation.

In the initial state immediately after the power is turned on, the CR oscillating circuit oscillates itself with the time constant determined by the resistor 105 and the capacitor 106. The output pulses with frequency P1 of the CR oscillating circuit 92 forcedly synchronized with the solid state oscillating circuit 91 is equal to the frequency of the output pulses from the solid state oscillating circuit 91.

For this reason, a delay time error is caused due only to the difference in cycle time between the output pulses from the solid state oscillating circuit 91 and the output pulses from the CR oscillating circuit 92 during the period when the output pulses are output as a result of independent oscillation of the CR oscillating circuit 92 and, in addition, since the period of time is short, a cumulative time error is insignificant and the delay time can be obtained with a high precision.

By setting the threshold level of the NAND gate 102 to a relatively low level, because the CR oscillating circuit 92 is forcedly synchronized with the solid state oscillating circuit 91 in an earlier stage, in which the amplitude of the output pulses becomes larger, the delay time error can be made small.

The above circuit is proposed in, for example Japanese Patent Application Publication (25079/1986).

Fifth Embodiment

Figure 12:
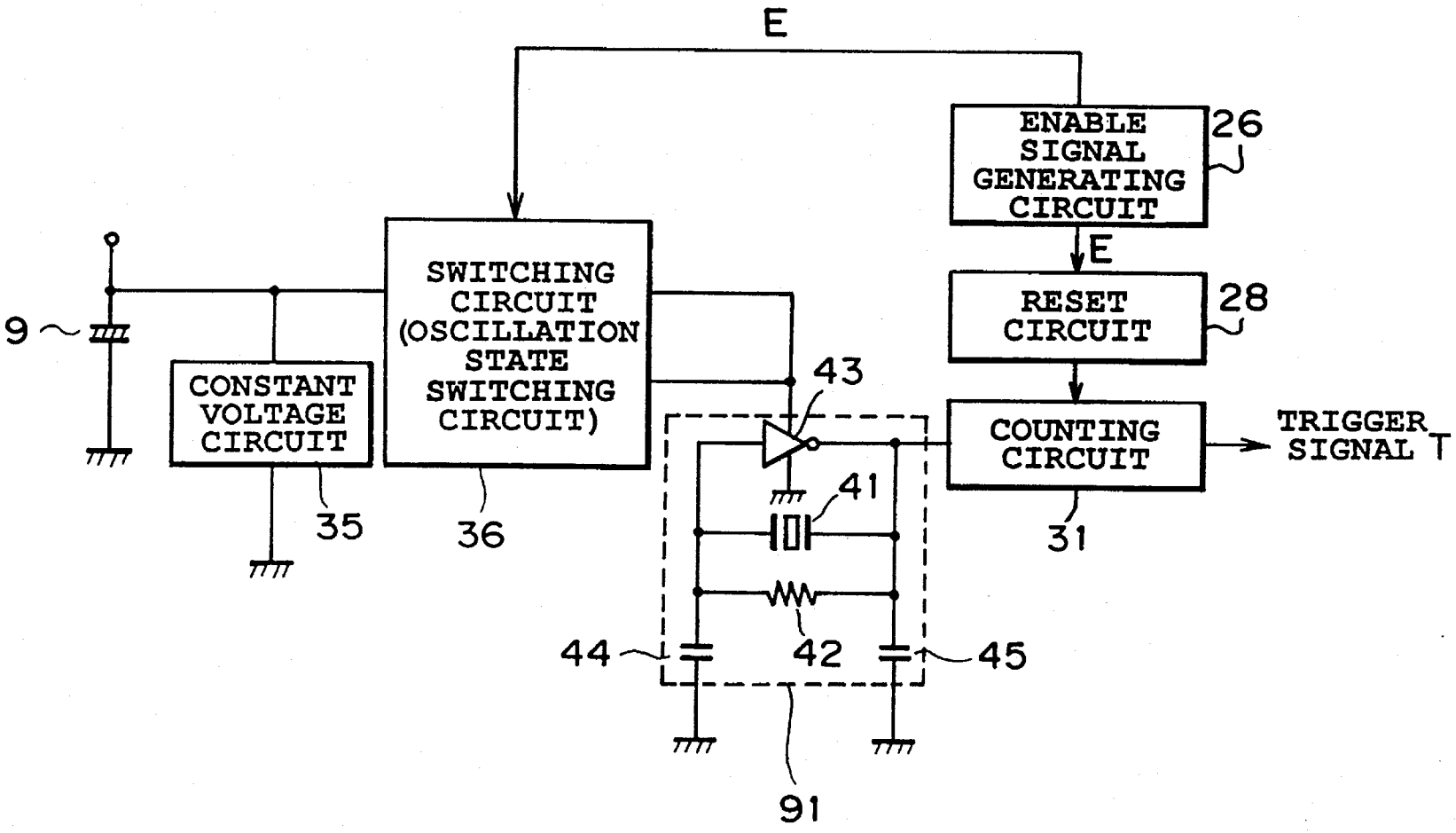
FIG. 12 is a circuit diagram of a fifth embodiment of the present invention.

FIG. 12 is an embodiment of the electronic delay detonator shown in FIG. 5 in a case where the oscillating circuit 20 is a solid state oscillating circuit having an inversion type of amplifier with a solid state vibration element and a load capacitor in a feed-back circuit, and the supply voltage to be supplied to the solid state oscillating circuit is switched to a lower voltage by a switching circuit.

FIG. 12, the same components as in FIG. 5 are assigned the same reference numerals, respectively, and the description will be omitted.

In FIG. 12, because the solid state oscillating circuit 91 is the same as that shown in FIG. 10, the same reference numeral is assigned to it and the description will be omitted.

The power supply voltage of the solid state oscillating circuit 91, the voltage of the energy storing capacitor 9 across the terminals, and a constant voltage obtained by dropping the voltage across the terminals and stabilizing the dropped voltage by the constant voltage circuit 35, is selectively supplied by the switching circuit 36.

At the time when the energy is supplied from the blasting unit 1, and the switching circuit 36 is in the state in which it is directly connected to the terminal of the energy storing capacitor 9, a voltage is directly applied from the energy storing capacitor to the solid state oscillating circuit 91.

Next, after the output of the solid state oscillating circuit 91 reaches the steady state, the enable signal is output from the enable signal generating circuit 26 to switch the connection of the switching circuit 36. As a result, the output voltage of the constant voltage circuit 35 is supplied to the oscillating circuit 20 as the power supply voltage.

That is, the solid state oscillating circuit 91 is designed to operate with a high voltage from the energy storing capacitor 9 only during the first transit oscillation state and to operate with a reduced constant voltage in the second steady state of oscillation.

Since the high voltage is supplied to the solid state oscillating circuit 91 in the first oscillation state, the frequency of the oscillation pulses is different from that of oscillation pulses in the steady state, i.e., the frequency of oscillation in the first state is somewhat higher than that of oscillation in the second steady state of oscillation. However, since the increase in amplitude of the oscillation pulses is accelerated, the rising time of the oscillation can be accelerated faster, as result.

The power consumption in the first state of oscillation is required not to increase extremely. Even if the increase of the power consumption is suppressed a few times more than that in the steady state of oscillation, the effect of acceleration can be sufficiently obtained.

In the construction shown in FIG. 12, for instance, when the charged voltage of the energy storing capacitor 9 is 15 V, the time required for the solid state oscillating circuit 91 to reach the steady state of oscillation can be reduced to about ⅓ compared to a case where the circuit 91 is initiated with the output of 3.3 V from the constant voltage circuit 35.

The circuit shown in, for example, FIG. 9 may be used as the enable signal generating circuit 26.

See the Japanese Patent Application Laid-Open (207304/1992) as an example of the above oscillating circuit.

The solid state oscillating circuit 91 shown in FIG. 12 was described as the embodiment of the oscillating circuit 20 used for the electronic delay detonator shown in FIG. 3. However, it could be readily understood to a person skilled in the art that the solid state oscillating circuit 91 can constitute the oscillating circuit 20 used in the electronic delay detonator shown in FIG. 5.

Sixth Embodiment

Figure 13A:
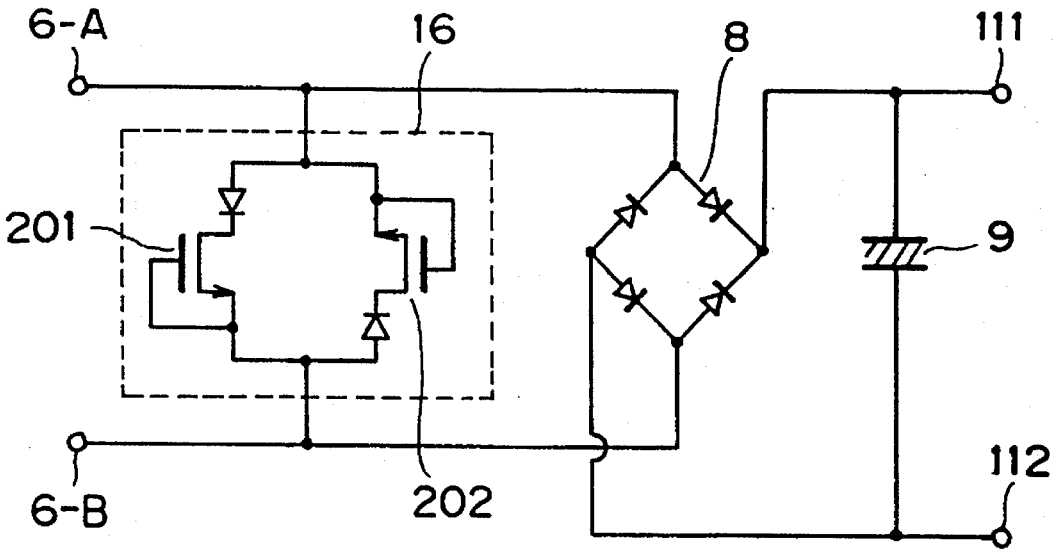
FIG. 13(*a*) and (*b*) are circuit diagrams of by-pass circuits for a sixth embodiment of the present invention.
Figure 13B:
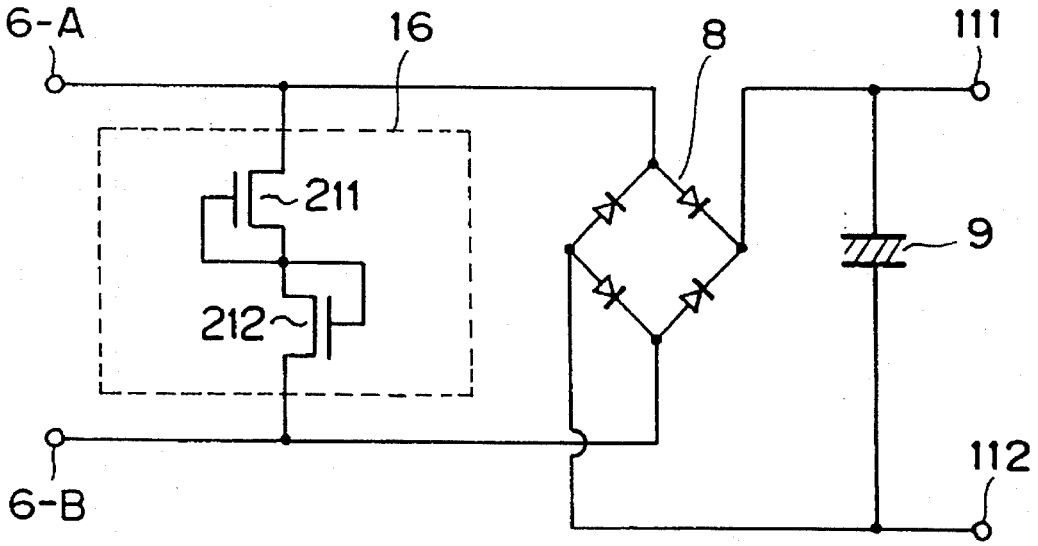

FIG. 13(*a*) and (*b*) show an embodiment of the electronic delay detonator in which a non-linear resistor is used as a by-pass circuit.

In FIG. 13(*a*) and (*b*), the same components as in FIGS. 3 and 5 are assigned the same reference numerals, respectively, and the description will be omitted.

In FIG. 13(*a*), the by-pass circuit 16 is supplied with current or voltage via input terminals 6-A and 6-B. Reference numerals 201 and 202 are a constant current type of non-linear elements, and depletion type N-channel MOS transistors are used, for example. These depletion type N-channel MOS transistors 201 and 202 are combined with each other in parallel to constitute the by-pass circuit 16.

In FIG. 13(*b*), the by-pass circuit 16 is supplied with current or voltage via input terminals 6-A and 6-B. Reference numerals 211 and 212 are a constant current type of non-linear elements, and depletion type of N-channel MOS transistors are used for example. These depletion type N-channel MOS transistors 211 and 212 are combined with each other in series to constitute the by-pass circuit.

Figure 14:
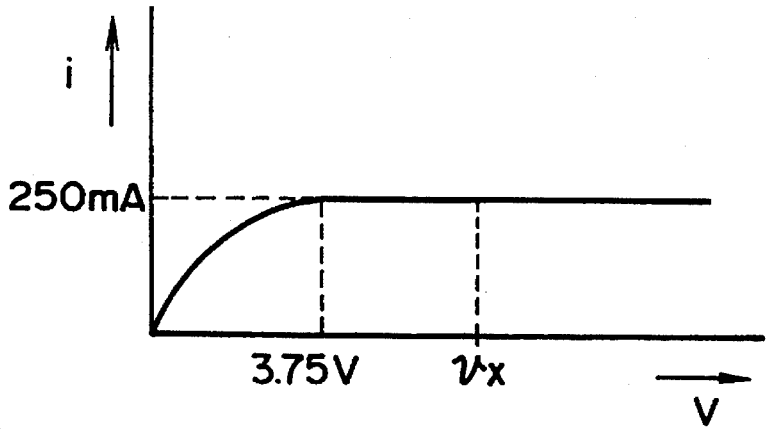
FIG. 14 is a characteristic curve of a non-linear element in the sixth embodiment.

The characteristic of a non-linear type of by-pass circuit in which the depletion type N-channel MOS transistors 201, 202, 211, and 212 are combined is shown in FIG. 14.

The by-pass circuit is inserted to prevent accidental explosion due to stray current. If the stray current of, for example, 250 mA flows, the voltage across the terminals rises to 3.75 V, as shown in FIG. 14. However, since the blasting criteria is Vx for example, the blasting does not occur. The by-pass circuit having such characteristic can be used safely for the stray current of 250 mA at maximum.

The characteristic of constant current type of non- linear element shown in FIG. 14 can be designed arbitrarily and it is easy to change the characteristics of depletion type N-channel MOS transistors 201, 202, 211, and 212 to match the blasting sensibility of the electronic delay detonator.

Figure 15:
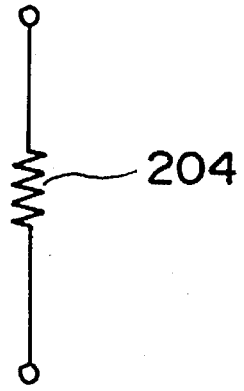
FIG. 15 is a diagram showing a linear resistor element used in a by-pass circuit.

The characteristic is compared to that where the by-pass circuit has a linear resistor element 204 as shown in FIG. 15. When the resistance of the nonlinear resistor element is 15 ohms, if current of 250 mA flows, the difference in voltage between the input terminals is 3.75 V. As a result, the same result can be obtained where the by-pass circuit is composed of the non-linear resistor element 16 as shown as in FIG. 13(*a*) and (*b*).

However, in this case, as the voltage between the terminals becomes higher, the current flowing into the by-pass circuit 16 increases if the total current becomes more, so that a current loss is caused in the electric energy supplied from the blasting unit.

In the case where the by-pass circuit 16 is comprised of the non-linear elements 201, 202, 211, and 212, such a loss is less. For this reason, the number of targets to be exploded at one time can be possibly increased in normal blasting with a series connection.

Further, when a small current of, for example, 10 mA or below is flowing, it flows via the by-pass circuit 16. In this case, because of the by-pass circuit 16, the voltage drop appears at the terminals 6-A and 6-B, making it possible to measure the conductive state of the electronic delay detonator by detecting the voltage. As a result, the connection can be confirmed before the blasting.

Seventh Embodiment

Figure 16:
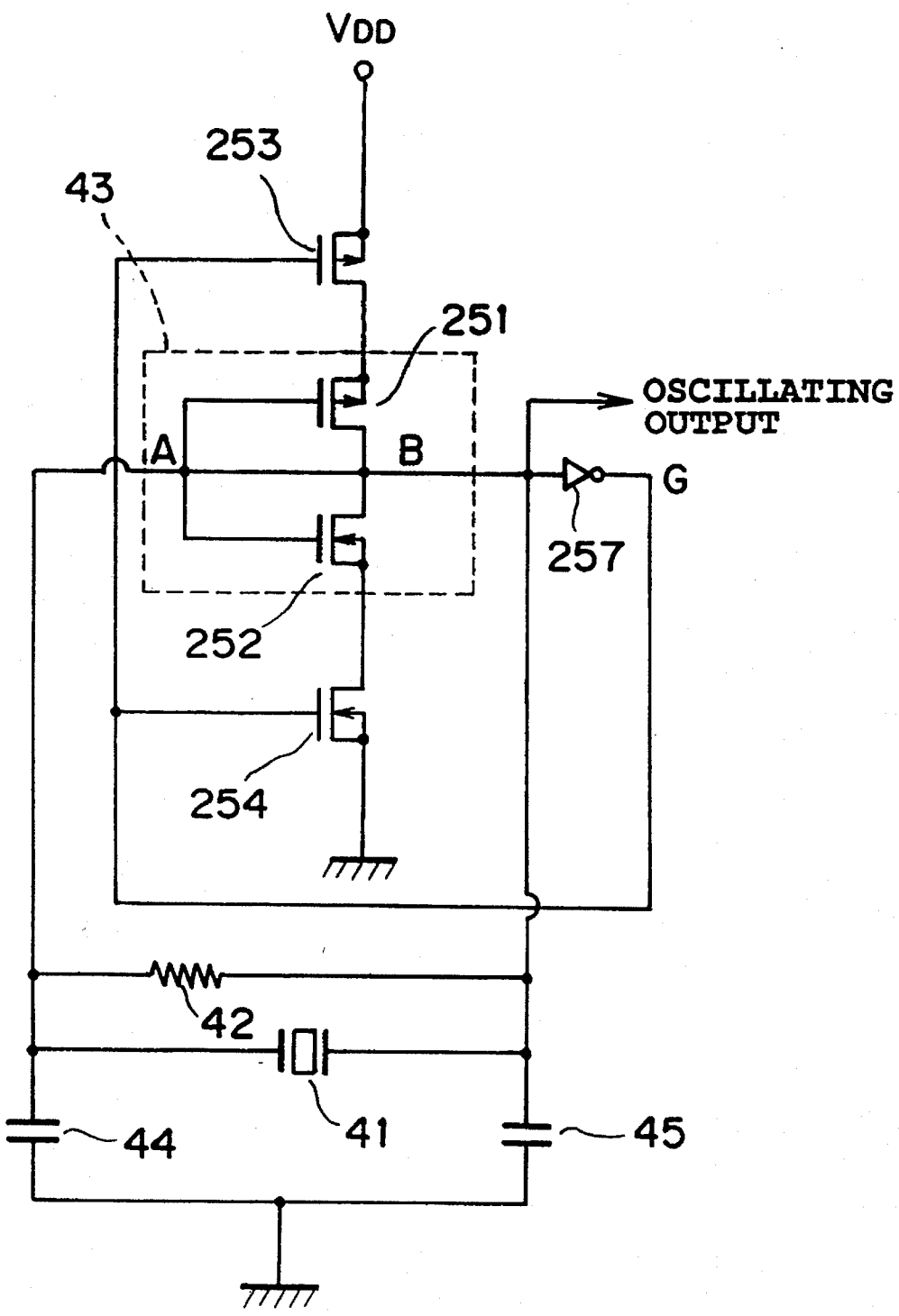
FIG. 16 is a circuit diagram of a seventh embodiment of the present invention.

FIG. 16 is a diagram showing another embodiment of the oscillating circuit 20 used in the electronic delay detonator, wherein the oscillating circuit 20 includes an inversion type of amplifier including a feed-back circuit having a solid state vibration element and a capacitor and composed of C-MOS transistors, and uses a current limiting circuit for limiting a current supplied to the C-MOS transistors.

In FIG. 16, reference numerals 251 and 253 denote P-channel MOS transistors, and reference numerals 252 and 254 denote N-channel MOS transistors. A reference numeral 257 denotes an inverter.

The solid state oscillating circuit is comprised of the inversion type of amplifier 43 composed of the P-channel MOS transistor 251 and the N-channel MOS transistor 252, including the feed-back circuit having the solid state vibrating element 41, resistor 42, gate capacitor 44, and drain capacitor 45.

Figure 17:
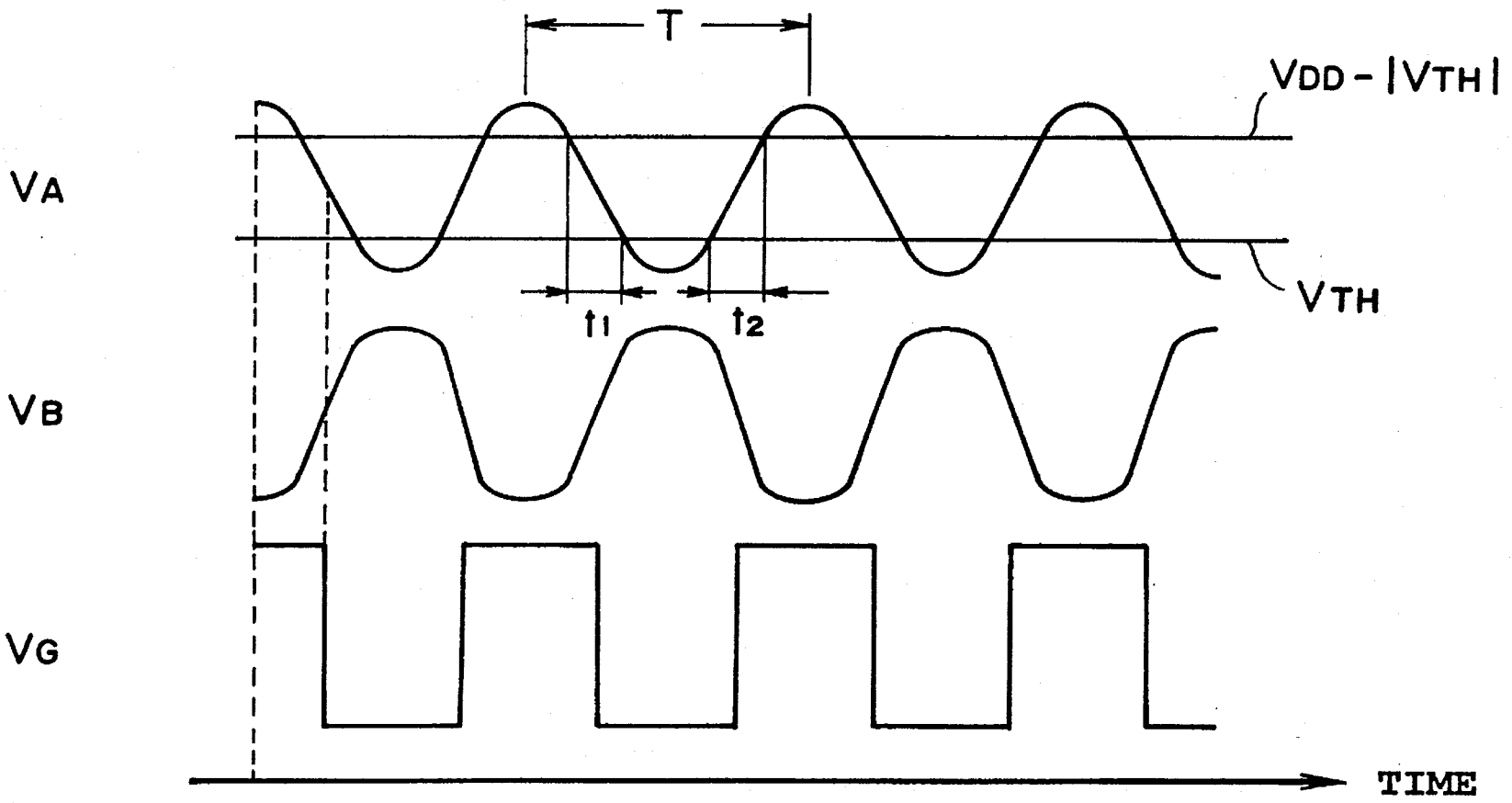
FIG. 17 is a timing chart of the operation of the seventh embodiment.

When this solid state oscillating circuit oscillates, the output signal $V_B$ at the output terminal B of the inversion type of amplifier 43 is fed back to an input terminal A of the inversion type of amplifier 43 via the feed-back circuit and an input signal $V_A$ shown in FIG. 17 is also applied to the input terminal A. As the waveform of the input signal $V_A$ changes gradually, the P-channel MOS transistor 251 and the N-channel MOS transistor 252 are turned on during a period of time determined by a power supply voltage $V_{DD}$ and the threshold voltages of the P-channel MOS transistor 251 and N-channel MOS transistor 252, (t1+t2 in FIG. 17). As a result, a through current flows.

However, because the output signal ($V_G$ in FIG. 17) of the inversion type of amplifier 43 which is inverted by the inverter 257 and shaped in a rectangular manner is fed back to the gates of the P-channel MOS transistor 253 and N-channel MOS transistor 254, the through current due to the P-channel MOS transistor 251 and N-channel MOS transistor 252 is decreased. As a result, the power consumed in the solid state oscillating circuit can be reduced effectively.

This structure of the current limiting circuit can be applied to all the solid state oscillating circuits using C-MOS transistors for an inversion type of amplifier.

See the Japanese Patent Application Laid-Open (21754/1977) for the solid state oscillating circuit having such a structure, for example.

It is clear that once a person skilled in the art has the teaching of the present invention the electronic delay detonator can be constructed by various combinations of the circuits disclosed in the above first to seventh embodiments.

INDUSTRIAL APPLICABILITY

Therefore, according to the present invention, in the electronic delay detonator in which energy is received only from a blasting unit to determine a delay time, a period of time from when an oscillating circuit used in the electronic delay detonator starts to operate to when it can oscillate stably can be shortened and therefore the precision of the delay time can be improved.

According to the present invention, in the electronic delay detonator in which energy only is received from a blasting unit to determine a delay time, the precision of the delay time can be improved without measuring a period of time from when an oscillating circuit-used in the electronic delay detonator starts to operate to when it can oscillate stably. According to the present invention, in the electronic delay detonator in which energy is received only from a blasting unit to determine a delay time, a period of time from when an oscillating circuit used in the electronic delay detonator starts to operate to when it can oscillate stably can be shortened without increasing the power consumption greatly or increasing it slightly.

Further, according to the present invention, in the electronic delay detonator in which energy is received only from a blasting unit to determine a delay time, a power consumption of an oscillating circuit used in the electronic delay detonator can be suppressed.

According to the present invention, there is obtained an electronic delay detonator having a structure by which an accidental explosion caused by stray current at a blasting site can be avoided.

Furthermore, according to the present invention, the connection of each of the electronic delay detonators can be confirmed.

We claim:

1. A delay detonator comprising:

first and second input terminals for receiving electrical energy supplied by a blasting unit;

a rectifying circuit having an input connected to at least one of said first and second input terminals;

an energy storing circuit connected to an output of said rectifying circuit;

an oscillating circuit for outputting oscillation pulses which operates based on storage energy stored in said energy storing circuit and which has a first transitory oscillation state in which the oscillation pulses are output immediately after said oscillating circuit starts to operate and a second steady oscillation state;

an enable signal generating circuit for detecting elapsed time relative to a time of starting the supply of electric energy by the blasting unit to generate an enable signal;

an oscillation state switching circuit for switching from said first oscillation state to said second oscillation state in response to the enable signal;

a trigger signal generating circuit for generating a trigger signal in response to a counted predetermined number of said oscillation pulses; and a discharge circuit for discharging the stored electrical energy in response to the trigger signal.

2. An electronic delay detonator according to claim 1, further comprising a by-pass circuit connected across said first and second input terminals.

3. An electronic delay detonator according to claim 2, wherein said by-pass circuit comprises a non-linear resistor element.

4. An electronic delay detonator according to claim 1, wherein said oscillating circuit is a solid state oscillating circuit comprising an inversion type of amplifier including a feed-back circuit having a solid state vibration element and a load capacitor whose capacitance is changed by said oscillation state switching circuit.

5. An electronic delay detonator according to claim 1, wherein said oscillating circuit is a solid state oscillating circuit comprising an inversion type of amplifier including a feed-back circuit having a solid state vibration element and a load capacitor whose capacitance is changed by said oscillation state switching circuit, and wherein said trigger signal generating circuit comprises:

a counting circuit for counting the oscillation pulses; and a reset circuit responsive to start of supply electrical energy for holding said counting circuit in a reset state and responsive to the enable signal for releasing said counting circuit from the reset state.

6. An electronic delay detonator according to claim 1, wherein said oscillating circuit comprises:

a solid state oscillating circuit; and a CR oscillating circuit connected to said solid state oscillating circuit in a cascade manner for operating to output pulses the operation of said CR oscillating circuit being stopped in response to said oscillation state switching circuit.

7. An electronic delay detonator according to claim 1, wherein said oscillating circuit is a solid state oscillating circuit comprising an inversion type of amplifier including a feed-back circuit having a solid state vibration element and a capacitor, and a power supply voltage supplied to said solid state oscillating circuit is switched to a lower voltage in response to said oscillation state switching circuit.

8. An electronic delay detonator according to claim 1, wherein said oscillating circuit comprises:

a solid state oscillating circuit comprising an inversion type of amplifier including a feed-back circuit having a solid state vibration element and a capacitor; and a circuit for switching a power supply voltage to be supplied to said solid state oscillating circuit to a lower voltage in response to said oscillation state switching circuit, and wherein said trigger signal generating circuit comprises:

a counting circuit for counting the oscillation pulses; and a reset circuit responsive to start of supply of electrical energy responsive to the enable signal for holding said counting circuit in a reset state, and responsive to the enable signal for releasing said counting circuit from the reset state.

9. An electronic delay detonator according to claim 4, wherein said solid state oscillating circuit comprises:

said inversion type of amplifier comprising C-MOS transistors; and a current limiting circuit for limiting a current to be supplied to said C-MOS transistors.

10. An electronic delay detonator according to claim 5, wherein said solid state oscillating circuit comprises:

said inversion type of amplifier comprising C-MOS transistors; and a current limiting circuit for limiting a current to be supplied to said C-MOS transistors.

11. An electronic delay detonator according to claim 6, wherein said solid state oscillating circuit comprises:

said inversion type of amplifier comprising C-MOS transistors; and a current limiting circuit for limiting a current to be supplied to said C-MOS transistors.

12. An electronic delay detonator according to claim 7, wherein said solid state oscillating circuit comprises:

said inversion type of amplifier comprising C-MOS transistors; and a current limiting circuit for limiting a current to be supplied to said C-MOS transistors.

13. An electronic delay detonator according to claim 8, wherein said solid state oscillating circuit comprises:

said inversion type of amplifier comprising C-MOS transistors; and a current limiting circuit for limiting a current to be supplied to said C-MOS transistors.

* * * * *